US009902592B2

(12) United States Patent
Sonnenmoser et al.

(10) Patent No.: US 9,902,592 B2
(45) **Date of Patent: *Feb. 27, 2018**

(54) METHOD AND MONITORING DEVICE FOR TESTING AN ELEVATOR SYSTEM

(75) Inventors: Astrid Sonnenmoser, Hochdorf (CH); David Michel, Thalwil (CH); Martin Hess, Baar (CH)

(73) Assignee: INVENTIO AG, Hergiswil (CH)

( * ) Notice: Subject to any disclaimer, the term of this patent is extended or adjusted under 35 U.S.C. 154(b) by 922 days.

This patent is subject to a terminal disclaimer.

(21) Appl. No.: 14/237,390

(22) PCT Filed: Jul. 24, 2012

(86) PCT No.: PCT/EP2012/064541

§ 371 (c)(1),
(2), (4) Date: Feb. 6, 2014

(87) PCT Pub. No.: WO2013/020806

PCT Pub. Date: Feb. 14, 2013

(65) Prior Publication Data

US 2014/0190773 A1 Jul. 10, 2014

(30) Foreign Application Priority Data

Aug. 11, 2011 (EP) ..... 11177268
Dec. 19, 2011 (EP) ..... 11194235

(51) Int. Cl.
*B66B 5/00* (2006.01)
*B66B 13/22* (2006.01)

(52) U.S. Cl.
CPC ..... *B66B 5/0006* (2013.01); *B66B 5/0031* (2013.01); *B66B 13/22* (2013.01)

(58) Field of Classification Search
CPC ..... B66B 5/0006; B66B 5/0031; B66B 13/22
See application file for complete search history.

(56) References Cited

U.S. PATENT DOCUMENTS 6,267,219 B1 * 7/2001 Spannhake ..... B66B 29/005 198/322
7,938,231 B2 * 5/2011 Ueda ..... B66B 1/32 187/288

(Continued)

FOREIGN PATENT DOCUMENTS

WO 2009010410 A1 1/2009
WO 2010097404 A1 9/2010

*Primary Examiner* — Sujoy Kundu
*Assistant Examiner* — Catherine Rastovski
(74) *Attorney, Agent, or Firm* — William J. Clemens; Shumaker, Loop & Kendrick, LLP

(57) ABSTRACT

A test method is applied to an elevator system having a control unit and at least one bus node. The bus node has a first microprocessor and a second microprocessor and the control unit and the bus node communicate by a bus. Furthermore, the first microprocessor and the second microprocessor are connected without interruption by a signal line. The test method includes the steps: a specification signal is transmitted by the control unit to the first microprocessor, the first microprocessor transmits the signal to the second microprocessor, and the second microprocessor provides the signal for the control unit. Finally, the control unit verifies whether the provided signal corresponds to a signal expected by the control unit. The elevator system includes a monitoring device for carrying out the test method.

12 Claims, 2 Drawing Sheets

(56) References Cited

U.S. PATENT DOCUMENTS

| | | | | |
|---|---|---|---|---|
| 2006/0157305 | A1* | 7/2006 | DePlazes | B66B 5/0031 187/391 |
| 2007/0090943 | A1* | 4/2007 | Tomek | B66B 5/0006 340/521 |
| 2011/0303492 | A1* | 12/2011 | Sonnenmoser | B66B 13/22 187/247 |

* cited by examiner

METHOD AND MONITORING DEVICE FOR TESTING AN ELEVATOR SYSTEM

FIELD

The invention relates to a test method for an elevator installation and to a monitoring device for carrying out the test method.

BACKGROUND

Conventional elevator installations have safety circuits which consist of safety elements connected in series. These safety elements monitor, for example, the state of shaft or car doors. Such a safety element may be a contact. An open contact shows, for example, that a door is open and a potentially impermissible door state has occurred. If an impermissible open state of the doors is now identified with the contact open, the safety circuit is interrupted. This results in a drive or brakes, which act on the travel of an elevator car, stopping the elevator car.

The patent specification WO 2009/010410 A1 discloses a monitoring device for an elevator installation having a control unit and at least one bus node and a bus. The bus enables communication between the bus nodes and the control unit. The bus node monitors, for example, the state of shaft doors using a safety element. The bus node has a first microprocessor and a second microprocessor. In this case, the first microprocessor is designed to read digital specification signals from the control unit, to convert said signals into an analog signal and to apply the latter to the safety element. The second microprocessor in turn measures the analog signal downstream of the safety element and converts said analog signal into a digital signal. The second microprocessor provides the control unit with this digital information. This information is either transmitted from the bus nodes to the control unit in the form of digital signals or is requested by the control unit by means of a query. If the safety switch is open and the second microprocessor consequently does not measure an analog signal, it spontaneously transmits an item of negative status information to the control unit.

So that safe operation of the elevator installation can be ensured, it is necessary to recurrently test the proper functionality of the two microprocessors, in particular the second microprocessor if a negative status occurs, that is to say if a safety element is open. WO 2009/010410 A1 proposes a specification signal test for this purpose. During this test, the control unit transmits different digital specification signals to the first microprocessor. The control unit can determine, on the basis of the digital signals transmitted or provided by the second microprocessor, whether the two microprocessors correctly convert the varying specification signals. A specification signal having the value of zero or an error value is a special situation in which the spontaneous response of the second microprocessor is provoked. The control unit transmits a digital specification signal having an error value to the first microprocessor, which converts said signal into an analog specification signal having an error value and applies it to the safety element. An open safety element is simulated as a result. The control unit expects the second microprocessor to spontaneously respond on the basis of the detected analog specification signal having an error value and to send a digital signal to this control unit. If these expectations of the control unit are met and the other specification signals are correctly converted, the control unit can assume that both the first microprocessor and the second microprocessor are operating properly.

A disadvantage of such testable bus nodes is their still relatively expensive production. In the mass production of these bus nodes, small cost savings already have a large price effect.

SUMMARY

An object of the present invention is therefore to provide a test method for an elevator installation and a monitoring device for carrying out the test method which make it possible to favorably produce the monitoring device, in particular the bus nodes.

A first aspect relates to a monitoring device for an elevator installation having a control unit and at least one bus node. The bus node has a first microprocessor and a second microprocessor. The control unit and the bus node communicate via a bus. The monitoring device is distinguished by the fact that the first microprocessor and the second microprocessor are connected without interruption via a signal line.

An uninterrupted signal line is intended to be understood here as meaning a signal line which comprises a continuous conductor which, like here, directly connects two microprocessors to one another, for example. In particular, a signal line which consists of a plurality of assembled subelements which are in contact is not considered to be a continuous conductor or uninterrupted signal line here. An uninterrupted signal line therefore does not comprise any subelements such as switches, safety elements or the like, even if these subelements are in contact with the signal line or parts of the latter.

In a second aspect, the monitoring device is part of a test method. The method comprises the following steps: the control unit transmits a specification signal to the first microprocessor, the first microprocessor transmits the signal to the second microprocessor via the signal line and the second microprocessor provides the signal for the control unit. Finally, the control unit verifies whether the signal provided corresponds to a signal expected by the control unit.

The advantage of this monitoring device is that, during the test method, the specification signal transmitted by the control unit and then converted in the first microprocessor is transmitted by the first microprocessor to the second microprocessor via a signal line. This is because this signal line connects the first microprocessor and the second microprocessor without interruption, with the result that the second signal line directly connects the first microprocessor and the second microprocessor. It is particularly advantageous that the signal line is arranged inside the bus node. Since this signal line does not contain any additional elements, such as a safety element or a switch, and can be very short, its resistance is very small. Signals can therefore be transmitted from the first microprocessor to the second microprocessor with very little energy. In comparison with the bus node described at the outset, a low-performance signal amplifier can accordingly be used. The bus node can therefore be produced in a particularly favorable manner.

In a first embodiment of the test method, the control unit transmits a specification signal having a first value to a bus node. In response, the bus node provides a signal having a second value. The control unit then verifies whether the second value provided can be associated with the first transmitted value. The second value can be associated with the first value when the second value provided corresponds to a second value expected by the control unit in response to the first value. If the second value provided can be associated, the test has been passed. If the second value provided cannot be associated with the first value, the test is considered to not have been passed.

Furthermore, the first microprocessor of the bus node reads the specification signal having the first value, which is transmitted by the control unit, and converts this specification signal into a bus-node-internal signal which is transmitted by the first microprocessor to the second microprocessor via the signal line. The second microprocessor reads this signal, converts it into a response signal having a second value and provides the control unit with the response signal.

In a preferred first embodiment, the specification signal is a first digital current value. The first microprocessor reads in this current value and converts it into an analog current signal with a current intensity corresponding to the first digital current value of the specification signal. The first microprocessor applies the analog current signal to the signal line. The second microprocessor measures the current intensity of the analog current signal and converts the measured current intensity into a digital signal having a second current value corresponding to the measured current value. The second microprocessor provides the control unit with this digital signal as a response signal. The control unit verifies whether the second current value can be associated with or corresponds to the first transmitted current value.

Instead of the current value, it is also possible to specify a voltage value, a frequency value, a switched-on duration value or a code value. The first microprocessor accordingly applies an analog signal comprising one of these values to the signal line.

Alternatively, the first microprocessor applies a digital signal having a code value which preferably corresponds to a code value of the specification signal to the signal line. This code value is read by the second microprocessor and is accordingly provided to the control unit. The conversion of the digital signal into an analog signal and back into a digital signal again in the first and second microprocessors is dispensed with here. In this alternative, the code value may be any number or a number sequence.

At least two queries having two different specification values are preferably carried out during this test method. If the value of the response signal provided can be associated twice with the two different values of the specification signals, the test is considered to have been passed.

The control unit preferably carries out the test method for the bus node at recurring intervals of time. The interval of time depends on the reliability of the first and second microprocessors used and is between 1 second and 100 seconds.

In the event of negative verification of the digital signal provided or if the test is not passed, the control unit takes measures to change the elevator installation to a safe operating state.

In another embodiment of the test method, the control unit transmits a specification signal containing an error value to a bus node. A signal which is provided to the second microprocessor by a safety element and represents an unsafe state of the elevator installation is simulated during this test. In this case, the control unit expects the bus node being tested to spontaneously transmit a response signal to the control unit. A current zero value, a voltage zero value, a frequency zero value or a switched-on duration zero value corresponds to such an error value. One of these zero values is used, for example, to simulate an open safety element designed as a safety switch. A code value can likewise represent an unsafe state of the elevator installation or an error value.

In this case, the control unit transmits a specification signal having an error value to the first microprocessor. The latter reads in the value and applies a signal having an error value to the signal line inside the bus node. The second microprocessor reads in this signal having the error value and spontaneously transmits a response signal to the control unit. In this case too, the signal transmitted by the first microprocessor via the second signal line is an analog or digital signal.

DESCRIPTION OF THE DRAWINGS

The invention is illustrated and described in more detail below using a plurality of exemplary embodiments and two figures, in which.

DETAILED DESCRIPTION

As described at the outset, the present monitoring device 10 and the present test method are particularly suitable for use in elevator installations.

Figure 1:
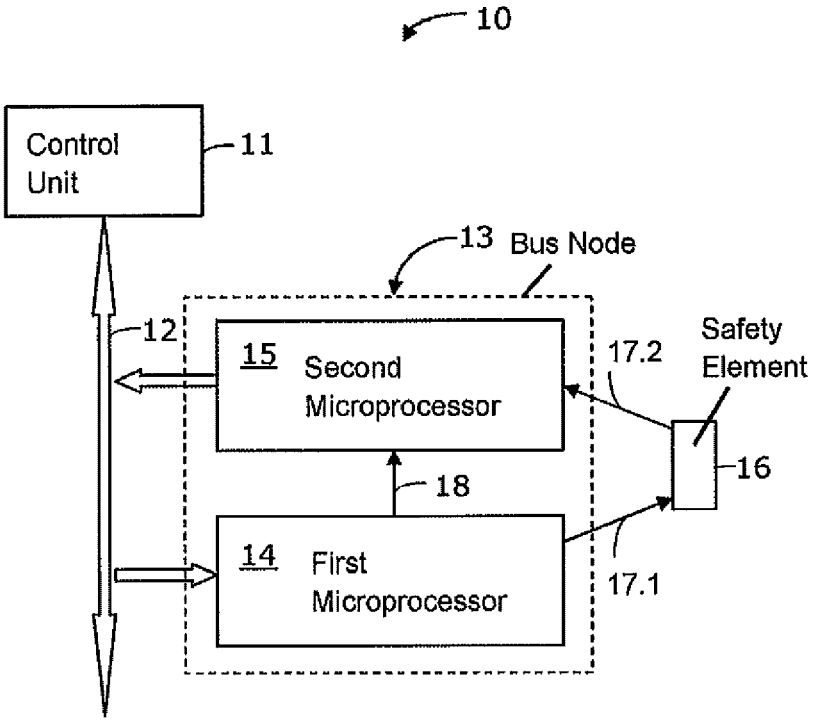
FIG. 1 shows a schematic view of a first embodiment of the monitoring device.

FIG. 1 shows a first embodiment of the monitoring device 10. The monitoring device 10 has a control unit 11 and at least one bus node 13. The control unit 11 and the bus node 13 communicate via a bus 12. Data can therefore be sent in both directions between the bus node 13 and the control unit 11 via the bus. The bus node 13 itself comprises a first microprocessor 14 and a second microprocessor 15. The first microprocessor 14 and the second microprocessor 15 are each designed in such a manner that the former receives specification signals from the control unit 11 and the latter provides the control unit 11 with state information as response signals. The bus node 13 is also connected to a safety element 16 via a signal line 17.1, 17.2 outside the bus node, a first part 17.1 of the signal line outside the bus node connecting the first microprocessor 14 to the safety element 16 and a second part 17.2 of the signal line outside the bus node connecting the safety element 16 to the second microprocessor 15. Finally, the first microprocessor 14 and the second microprocessor 15 are connected to one another without interruption via a signal line 18 inside the bus node.

The control unit 11, the bus 12 and the at least one bus node 13 form a bus system. Inside this bus system, each bus node 13 has its own, unique address. Messages are set up between the controller 11 and a bus node 13 using this address.

The control unit 11 passes digital specification signals to the first microprocessor 14 via the bus 12. In this case, the control unit addresses a particular bus node 13 and communicates the specification signal to the first microprocessor 14. The first microprocessor 14 receives this specification signal and generates an analog signal corresponding to the specification signal, which analog signal is applied to the signal line 17.1, 171 outside the bus node. The analog signal may be a particular voltage, current intensity, frequency or switched-on duration value.

The safety element 16 shows the state of a safety-relevant element. The safety element 16 is therefore used, for example, as a door contact, a bolt contact, a buffer contact, a flap contact, a movement control switch or an emergency stop switch. As a safety switch, the safety element 16 is designed, for example, such that a closed safety element 16 represents a safe state and an open safety element 16 represents a potentially dangerous state of an elevator installation.

When the safety element 16 is closed, the second microprocessor 15 measures, downstream of the safety element 16, the analog signal arriving via the signal line 17.2 outside the bus node. After measurement, the second microprocessor 15 converts the measured analog signal into a digital signal. The second microprocessor 15 finally provides the control unit 11 with the digital signal.

The safety element 16 monitors, for example, the state of a car or shaft door. If one of these doors is open, the safety element 16 is likewise open and therefore indicates a potentially dangerous state of the elevator installation. In this case, the signal line 17.1, 17.2 outside the bus node is interrupted. As described above, the second microprocessor 15 measures the analog signal arriving downstream of the safety element 16. If a safety element 16 is open, this analog signal can no longer be measured by the second microprocessor 15. In this case, the second microprocessor 15 measures an analog signal having an error value of zero. Depending on the type of analog signal, there is therefore an error current with a current value of 0 mA, an error voltage with a voltage value of 0 mV, an error frequency with a frequency value of 0 Hz or an error switched-on duration value with a switched-on duration value of 0%. If an error value is now measured by the second microprocessor 15, the second microprocessor 15 spontaneously transmits a digital signal to the control unit 11 via the bus 12 on the basis of the measured error value.

Thanks to the unique address of the bus node 13, the control unit 11 is able to accurately locate the error. If necessary, the control unit 11 takes measures to eliminate the error or to change the elevator to a safe operating mode. These operating modes comprise, inter alia, the maintenance of remaining availability of the elevator in a safe travel range of the elevator car, the evacuation of trapped passengers, an emergency stop or finally the alerting of maintenance and service personnel in order to free trapped passengers and/or in order to eliminate an error which cannot be eliminated by the control unit.

The safe operation of a bus node 13 primarily depends on the functionality of the first microprocessor 14 and of the second microprocessor 15. In particular, it must be ensured that the following steps are carried out by the first and second microprocessors 14, 15 without errors: conversion of the specification signal into an analog signal in the first microprocessor 14, measurement of the analog signal in the second microprocessor 15, provision of the response signal by the second microprocessor 15 and the spontaneous behavior of the second microprocessor 15 when measuring an analog signal having an error value.

During a first test, the functional behavior of a bus node 13 when converting a specification signal during normal operation is checked. In this case, the control unit 11 transmits a specification signal having a current, voltage, frequency or switched-on duration value in digital form to a selected bus node 13 by stating the address of the bus node 13. This specification signal is renewed at particular intervals of time, that is to say the control unit 11 transmits specification signal having a new current, voltage, frequency or switched-on duration value to the bus node 13. The new value preferably differs from the preceding value. Within such an interval of time, the first microprocessor 14 generates a corresponding analog signal in accordance with the specification signal. The first microprocessor 14 applies this analog signal to the signal line 18 inside the bus node. The second microprocessor 15 measures this analog signal and provides the measured value as a digital response signal. In time with the interval of time, the control unit 11 addresses the second microprocessor 15 of the bus node 13 and obtains the data relating to the current, voltage, frequency or switched-on duration value provided as a digital response signal via a reading function.

The intervals of time between such specification/query cycles can be freely set, in principle, and primarily depend on the reliability of the bus node components. These intervals of time preferably last for several seconds. With a high degree of reliability, intervals of time of 100 seconds or longer can also be set.

The control unit 11 carries out this test method with all bus nodes 13 in order and checks their resonance. That is to say, the digital specification signals and the digital response signals provided by the respective second microprocessors 15 are verified or associated by the control unit 11. If the specification signals can be associated with the digital response signals provided, the control unit 11 recognizes that the first microprocessor 14 and the second microprocessor 15 are operating correctly when converting a specification signal during normal operation.

An open safety element 16 is simulated in a second test. The control unit 11 simulates the open safety element 16 by specifying a specification signal having an error value of 0 mA, 0 mV, 0 Hz or 0% to a particular bus node 13. This digital specification signal having an error value is converted by the first microprocessor 14 into an analog signal having an error value. In a next step, the first microprocessor 14 applies the analog signal to the signal line 18 inside the bus node. The second microprocessor 15 measures this analog signal and spontaneously reports to the control unit 11 in the case of a proper method of operation. With a positive output, this test guarantees that every opening of a safety element 16 results in spontaneous transmission of a digital response signal from the bus node 13 to the control unit 11.

This second test is recurrently carried out in terms of time for each bus node 13. In this case, the test time is largely dependent on the data transmission speed via the bus 12 and is generally 50 to 100 ms. The frequency of the zero specification test depends primarily on the reliability of the second microprocessor 15 used. The more reliable the second microprocessor 15, the more rarely it must be tested so that safe operation of the elevator can be ensured.

The specification test with an error value is generally carried out at least once a day. However, this test can also be repeated in the order of magnitude of minutes or hours.

Figure 2:
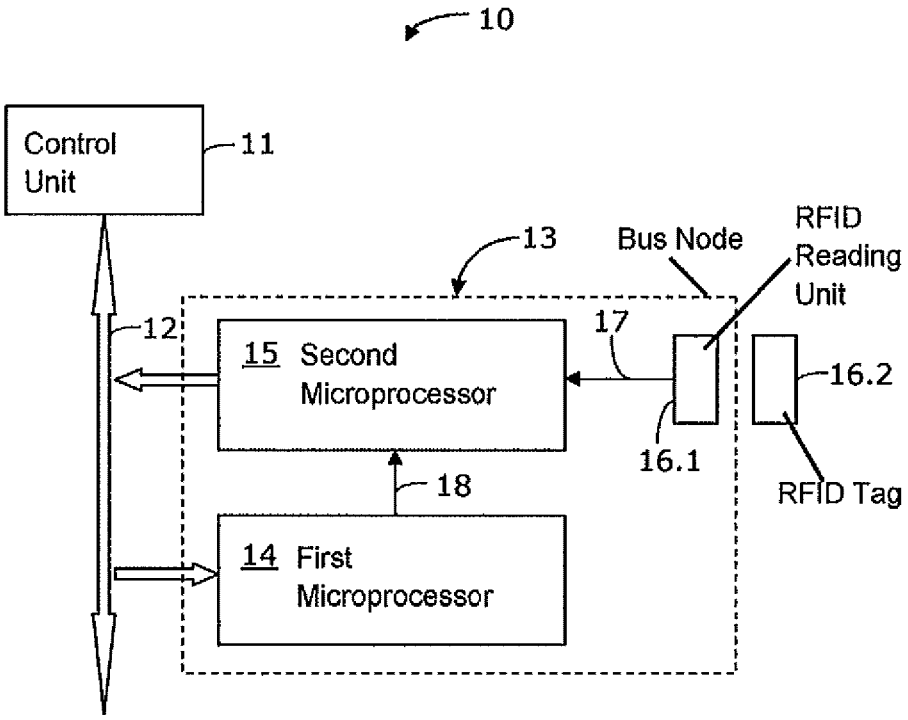
FIG. 2 shows a schematic view of a second embodiment of the monitoring device.

FIG. 2 shows a second embodiment of the monitoring device 10. This monitoring device 10 likewise comprises a control unit 11, at least one bus node 13 and a bus 12 which connects the control unit 11 to a bus node 13. In a manner corresponding to the first embodiment from FIG. 1, the bus node 13 has a first microprocessor 14 and a second microprocessor 15, which are connected to one another without interruption via a signal line 18 inside the bus node.

Unlike the first example, a contactless safety element 16.1, 16.2 is connected to the second microprocessor 15 via a signal line 17 inside the bus node. In this case, the contactless safety element 16.1, 16.2 comprises, for example, an RFID tag 16.2 and an RFID reading unit 16.1. The RFID tag 16.2 and the RFID reading unit 16.1 each have an induction coil. The induction coil in the RFID reading unit is supplied with electrical energy and excites the induction coil in the RFID tag if a certain distance is undershot.

In this case, the RFID tag 16.2 transmits a digital code value to the RFID reading unit 16.1 via the two induction coils. The RFID reading unit 16.1 reads in this digital code value and converts this code value into an analog signal having the same code value. The RFID reading unit 16.1 accordingly applies the analog signal to the signal line 17 inside the bus node. The second microprocessor 15 measures this analog signal, converts it into a digital response signal having the code value and provides said response signal for the control unit 11.

The contactless safety element 16.1, 16.2 monitors, for example, the state of a car or shaft door. As long as such a door is closed, the distance between the RFID tag 16.2 and the RFID reading unit 16.1 remains sufficiently small to enable the digital code value to be transmitted. The second microprocessor 15 accordingly provides the control unit 11 with a digital signal having the code value of the RFID tag 16.2 which has been read out. In contrast, in the case of an open door which constitutes a potential unsafe state of the elevator installation, the transmission of the code value to the RFID reading unit 16.1 is interrupted. The RFID reading unit 16.1 therefore does not read a code value or an error value. Accordingly, the second microprocessor 15 also measures a signal having an error value. In this situation, the second microprocessor 15 spontaneously transmits a digital signal to the control unit 11.

In this second embodiment of the monitoring device 10 as well, the reliable functionality of a bus node 13 is checked using two tests.

In a first test, the control unit 11 transmits a digital specification signal having a first code value to the first microprocessor 14. The first microprocessor 14 converts the specification signal into an analog signal having the code value and applies said analog signal to the signal line 18 inside the bus node. The second microprocessor 15 measures this analog signal and converts it into a digital response signal having the measured code value. Finally, the second microprocessor 15 provides the digital response signal for the control unit 11. The control unit 11 verifies whether the code value of the response signal corresponds to the code value of the specification signal. If the code value of the response signal can be associated with the code value of the specification signal, the test is considered to have been passed. The code value of the specification signal preferably differs from the code value of the RFID tag 16.2.

A second test relates to the simulation of an error value and the accordingly spontaneous reaction of the second microprocessor 15. In this case, the control unit 11 transmits a digital specification signal having an error value to the first microprocessor 14. The first microprocessor 14 converts this specification signal into an analog signal having the error value and applies this analog signal to the signal line 18 inside the bus node. The second microprocessor 15 measures the analog signal having the error value and spontaneously transmits a digital response signal to the control unit 11. The second test is positively concluded if the control unit 11 verifies the expected spontaneous reaction of the second microprocessor 15.

The intervals of time at which the control unit 11 transmits specification signals to a bus node 13 for test purposes can be set in accordance with the first embodiment of the monitoring device 10.

The two test methods in the second embodiment of the monitoring device 10 are likewise carried out by the control unit 11 for each bus node 13.

In one particularly preferred alternative, a digital signal which corresponds to the different values of the specification signal is respectively applied to the signal line 18 inside the bus node in the two embodiments of the monitoring device 10.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A test method for an elevator installation comprising: a control unit and at least one bus node, each bus node having a first microprocessor and a second microprocessor, the control unit and the bus node communicating via a bus, and the first microprocessor and the second microprocessor being connected with an uninterrupted signal line, the control unit transmitting a specification signal to the first microprocessor, the first microprocessor transmitting a first signal corresponding to the specification signal to the second microprocessor via the signal line; the second microprocessor providing a response signal for the control unit in response to the first signal; and the control unit verifying whether the response signal provided corresponds to a second signal expected by the control unit.

2. The test method according to claim 1 wherein the response signal provided by the second microprocessor is queried by the control unit at predetermined intervals of time.

3. The test method according to claim 2 wherein the intervals of time are between 1 second and 100 seconds.

4. The test method according to claim 1 wherein the control unit responds to a negative verification of the second signal by changing an operating mode of the elevator installation.

5. The test method according to claim 4 wherein changing the operating mode of the elevator installation includes a member selected from the group consisting of: maintaining a remaining availability of an elevator car in a travel range of the elevator car, evacuating trapped passengers, executing an emergency stop of the elevator installation, alerting maintenance and service personnel to free trapped passengers, and alerting maintenance and service personnel to eliminate an error which cannot be eliminated by the control unit.

6. The test method according to claim 1 wherein the specification signal is one of a voltage value, a current value, a frequency value, a switched-on duration value and a code value.

7. The test method according to claim 1 wherein the first signal transmitted from the first microprocessor to the second microprocessor is transmitted via a direct signal line inside the bus node.

8. The test method according to claim 1 wherein:

the control unit transmits a plurality of specification signals to the first microprocessor;

the first microprocessor transmits a plurality of first signals corresponding to the plurality of specification signals to the second microprocessor via the signal line;

the second microprocessor provides a plurality of response signals for the control unit in response to the plurality of first signals; and the control unit verifies whether the plurality of response signals provided corresponds to a plurality of second signals expected by the control unit.

9. The test method according to claim 1 including transmitting the specification signal having an error value from the control unit to the first microprocessor, the first microprocessor transmitting the first signal corresponding to the specification signal having the error value to the second microprocessor via the signal line, the second microprocessor spontaneously providing the response signal for the control unit in response to the first signal, and the control unit verifying whether the second microprocessor spontaneously transmits the response signal to the control unit.

10. A monitoring device for carrying out a test method for an elevator system comprising: a control unit for generating a specification signal; at least one bus node, each bus node including a first microprocessor and a second microprocessor; a bus connecting the control unit and the bus node, the control unit communicating the specification signal to the first microprocessor in the bus node via the bus; and the first microprocessor and the second microprocessor being connected with an uninterrupted signal line, the first microprocessor responding to the specification signal by generating a first signal to the second microprocessor, and the second microprocessor generating a response signal to the control unit via the bus.

11. The monitoring device according to claim 10 wherein the signal line directly connects the first microprocessor and the second microprocessor.

12. The monitoring device according to claim 10 wherein the signal line is arranged inside the bus node.

* * * * *